US005890999A

United States Patent [19]

Kildani

[11] Patent Number: 5,890,999

[45] Date of Patent: Apr. 6, 1999

[54] HAND EXERCISER AND METHOD OF USE THEREOF

[76] Inventor: Paul Kildani, 315 First St. Ste. V-190, Encinitas, Calif. 92024

[21] Appl. No.: 827,579

[22] Filed: Mar. 28, 1997

[51] Int. Cl.[6] ..... A63B 21/02

[52] U.S. Cl. ..... 482/49; 482/44; 482/47; 482/121

[58] Field of Search ..... 482/44, 47, 49, 482/121, 124

[56] References Cited

U.S. PATENT DOCUMENTS

| | | | |
|---|---|---|---|
| 1,549,710 | 8/1925 | Campbell . | |
| 2,541,851 | 2/1951 | Wright . | |
| 3,061,572 | 10/1962 | Packer . | |
| 3,347,545 | 10/1967 | Nichols . | |
| 3,601,923 | 8/1971 | Rosenberg . | |
| 3,748,779 | 7/1973 | Cherk et al. . | |
| 3,977,121 | 8/1976 | Goldfarb et al. . | |
| 4,100,779 | 7/1978 | Schachter . | |
| 4,169,336 | 10/1979 | Kuhn . | |
| 4,174,107 | 11/1979 | Hickey . | |
| 4,218,057 | 8/1980 | Wilson | 482/74 |
| 4,236,347 | 12/1980 | Fauls . | |
| 4,498,667 | 2/1985 | Tomar . | |
| 4,627,611 | 12/1986 | Kauffman . | |
| 4,752,072 | 6/1988 | Parsons . | |
| 4,877,166 | 10/1989 | Gelinas, Jr. . | |
| 4,929,211 | 5/1990 | Resnick et al. . | |
| 4,943,066 | 7/1990 | Lathim et al. . | |
| 4,952,190 | 8/1990 | Tarnoff et al. . | |
| 4,953,852 | 9/1990 | Donohue . | |
| 5,026,054 | 6/1991 | Osher et al. . | |
| 5,035,425 | 7/1991 | Edwards . | |
| 5,183,154 | 2/1993 | Slemp . | |
| 5,190,504 | 3/1993 | Scatterday . | |
| 5,350,342 | 9/1994 | Scatterday . | |
| 5,413,332 | 5/1995 | Montgomery . | |
| 5,472,994 | 12/1995 | Micallet et al. | 523/137 |
| 5,556,358 | 9/1996 | Scatterday . | |

FOREIGN PATENT DOCUMENTS

| | | |
|---|---|---|
| 3123055 | 6/1981 | Germany . |

*Primary Examiner*—Lynne A. Reichard
*Attorney, Agent, or Firm*—Rothwell Figg Ernst & Kurz

[57] ABSTRACT

A hand held exerciser includes a ball body having a resilient cover and a putty filler. The putty is preferably a tacky, water based material which is relatively freely compressed but generally does not flow in a liquid-like manner. The cover can be made with a plurality of elastomeric balloons around the putty. An outer opening in an outer balloon of the cover either is covered by a durable seal member or by attachment hardware having an attached object such as a key. The putty enables the ball to conform more exactly to one's hand grip, while allowing good resistance, weight and resiliency. The putty filler also helps to reduce unwanted spillage of filler material, and provides additional benefits not found in existing devices.

26 Claims, 8 Drawing Sheets

FIG. 2(A)
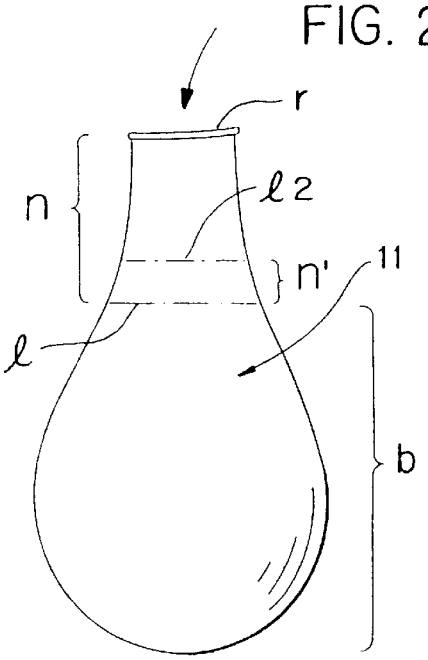
FIG. 2(B)
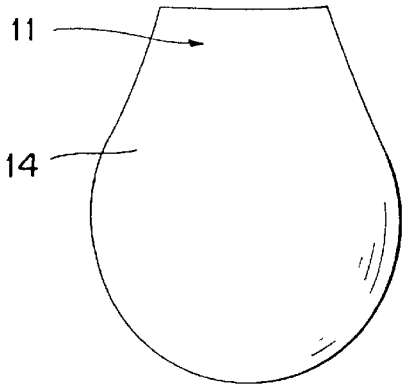
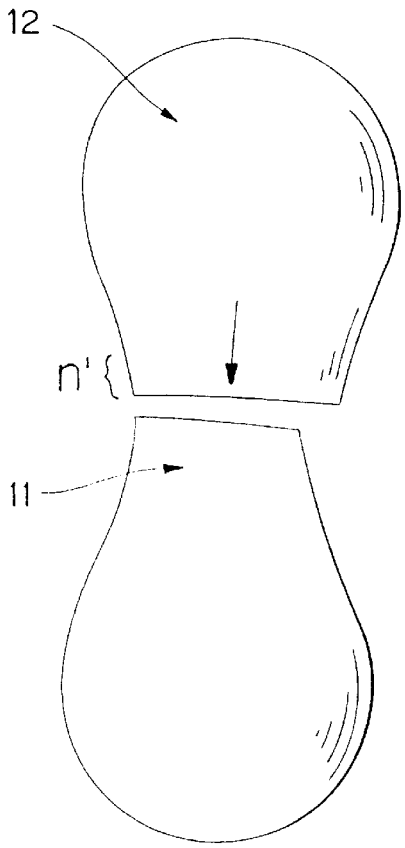
FIG. 2(C)
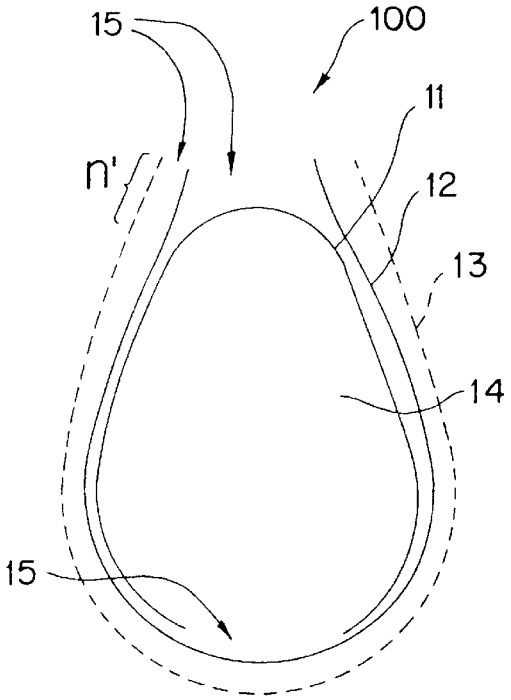
FIG. 2(D)

HAND EXERCISER AND METHOD OF USE THEREOF

BACKGROUND OF THE INVENTION

1. Field of the Invention

The present invention relates to hand exercisers and, in particular, to hand exercisers made with an elastic outer shell having a filler material therein.

2. Description of the Background Art

A variety of hand exercisers are known in the art, such as those made of solid rubber and those made of elastomeric balloons filled with particulate material. Typically, such exercisers are used for physical exercise as well as for mental relaxation and therapeutic use.

Exemplary filled balloon type hand exercisers are the SHARPER IMAGE DEADBALL (TM) and the exerciser described in U.S. Pat. No. 5,350,342 (Scatterday). The SHARPER IMAGE DEADBALL (TM) is similar to that of Scatterday and was on sale prior to the filing date thereof. Scatterday '342 shows an exerciser which is made with a plurality of latex layers 6–14. As discussed on column 3 of the reference, construction of the device involves the following: "[P] articulate material and lubricant that make up the core are initially inserted through hole 20 of the first latex layer 6 . . . This procedure is then repeated with the remaining layers . . . Once the core has been inserted in the final layer, glue is placed around the perimeter of hole 20 of layer 14 to fix the latex surrounding the hole to the underlying layer."

Among other problems, the Scatterday type device has problems pertaining to the filler used. Column 3, lines 10 et seq., of Scatterday states: "In practice, seeds such as millet have been used as the particles. As an alternative, the particles can be hard plastic or silicon beads or any other matter that is similar in size and shape to millet and that is hard enough to withstand compressive pressures . . . "

However, seeds such as millet disintegrate over time, damaging and/or altering the functioning thereof. Further, millet has a relatively large size such that its shape is seen through the stretched balloon layers imparting a pocked, or pimpled, appearance to the exerciser.

In addition, millet typically has a tear-like shape and sharp ends which can puncture the balloons. The use of such irregularly shaped particles can damage the balloons. Due to the thinness and the high elasticity of the balloon layers, known balloon filled exercisers have had a tendency to prematurely break or rupture—resulting in the release of particulate material therefrom.

In addition, the prior filler materials have undesirable squeezing characteristics for exercise, therapeutic uses and the like.

SUMMARY OF THE INVENTION

The present invention overcomes the above-noted and other problems pertaining to existing hand exercisers.

According to a first general aspect of the invention, a hand held exerciser is provided which includes: a) a ball body including an elastomeric shell and a filler material within the elastomeric shell; b) the elastomeric shell being made from a resilient and stretchable elastomeric material, said elastomeric shell having an interior cavity defined within the shell; c) the filler material filling the entire cavity within the shell being a putty which substantially maintains its shape without flowing, but which freely moves when compressed. The putty preferably has a tacky consistency such that it sticks to the interior of the elastomeric shell.

According to another aspect of the invention, a method of exercising an individual's hands is provided which includes the steps of: 1) providing a hand held exerciser in accordance with the first aspect of the invention noted above; 2) placing the hand held exerciser within the palm of an individual's hand; and 3) having the individual repeatedly compress the hand exerciser with sufficient force to exercise the muscles within the individual's wrist.

The above and other aspects of the present invention create notable advantages and uses which are not found in other known devices.

The exerciser can help to increase strength and dexterity in one's fingers, hands, wrists, and arms. It can also help to a) reduce stress and tension, b) reduce stiffness and pain, such as due to arthritis, and even to c) reduce blood pressure.

It is contemplated that the hand exerciser can be placed within a microwave oven or otherwise heated to provide heat therapy for relaxation of the muscles in one's hand. When heated, the exerciser can readily distribute heat to one's hand to relax the muscles in one's hand. Because the exerciser conforms well to one's grip, the conduction of heat is facilitated and the quality of the heat distribution is enhanced. Heating can also be used to provide additional flexibility of the exerciser, when desired.

The device can also be used in cold therapy treatments—e.g., placed within a freezer for a period of time. This can provide relaxing cold therapy for one's hand.

In contrast to using a particulate filler and to using a more viscous liquid filler, the use of a putty filler enables the device to have better squeezing characteristics. The use of a putty enables the ball to conform more exactly to one's hand grip, while allowing good resistance, weight and resiliency. The use of a putty filler also reduces unwanted spillage of filler material. The prior fillers included flowable particulate material which would readily spill out of the exerciser when the cover was torn. On the other hand, the putty filler will not readily spill when the cover is torn.

When the putty has a tacky consistency, the cover will conform to the contour of the putty. The exerciser will, thus, feel more like a single uniform material—creating a more interesting object. The use of mostly edible ingredients can further reduce any potential hazards that can result from spilled filler material. The preferred embodiments can also be easily and inexpensively manufactured.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which:

FIGS. 2(A)–2(D) illustrate stages during the fabrication of a preferred embodiment of a ball body of the invention;

FIG. 5(A) is a top view of an inner attachment member; FIG. 5(B) is a bottom view of an outer attachment member; FIG. 5(C) is a side view of the inner attachment member; FIG. 5(D) is a side view of the outer attachment member; FIG. 5(E) is crosssectional view of a portion of the attachment hardware in a locked condition, and FIG. 5(F) is a side view illustrating the assembly of the attachment hardware to the ball body.

DETAILED DESCRIPTION OF THE INVENTION

Figure 1A:
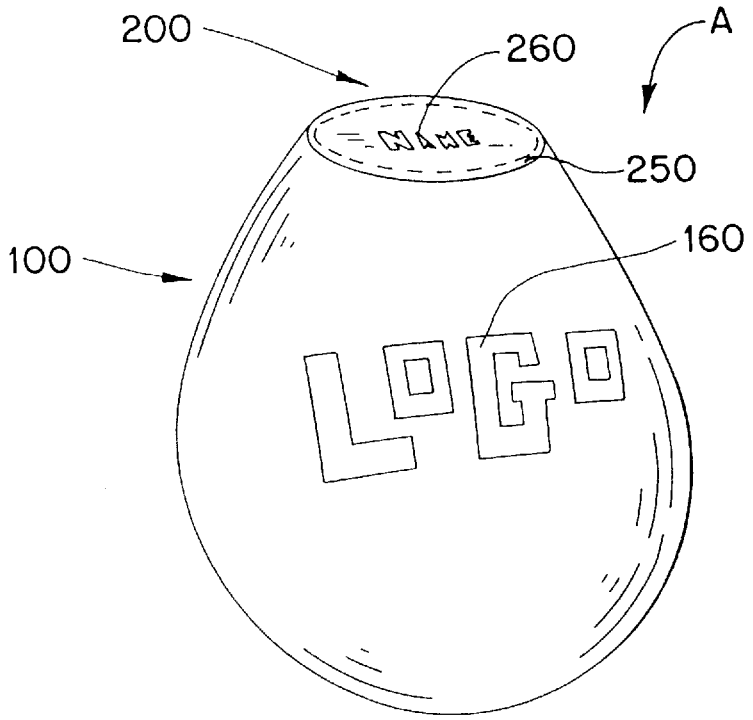
FIG. 1(A) is a perspective view of a hand exerciser according to a first embodiment of the invention.
Figure 1B:
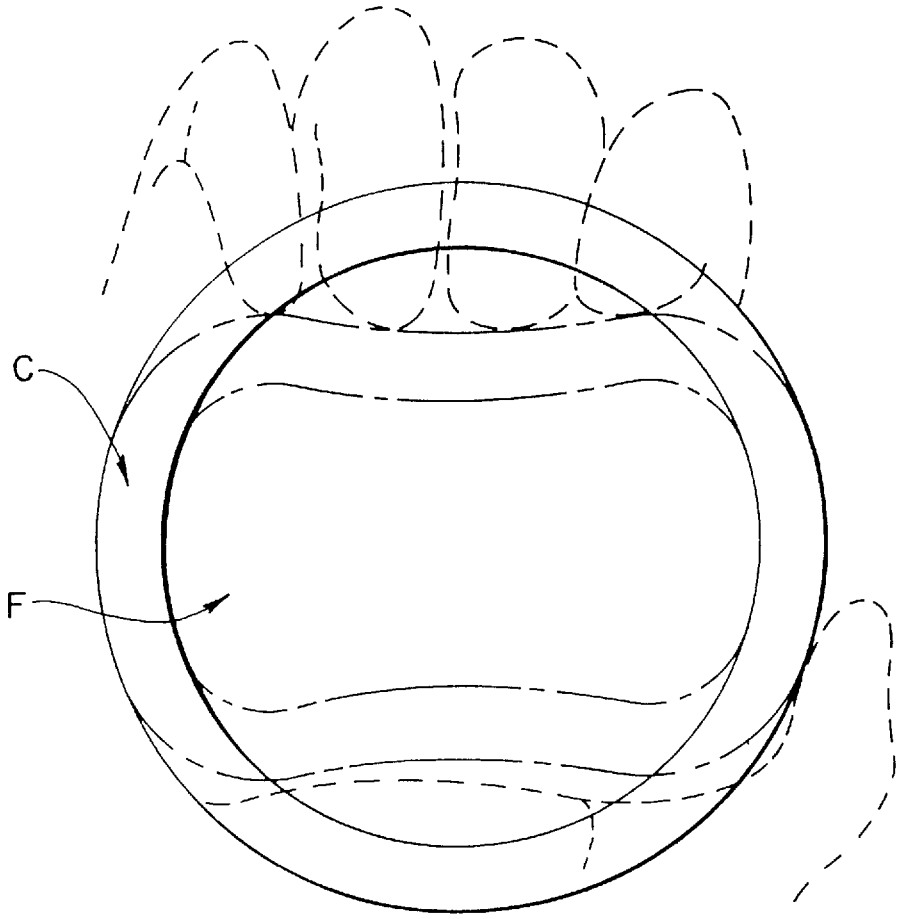
FIG. 1(B) is a cross-sectional view of a hand exerciser similar to that shown in FIG. 1(A)

FIG. 1 (A) illustrates a hand exerciser A having a ball body 100. The ball body 100 is a resilient body which can be held in one's hand and squeezed for relaxation and/or exercise of one's hand muscles. As shown in FIG. 1(B), the hand exerciser includes a resilient outer cover C and an inside filler material F.

The Filler Material

The present invention utilizes a putty F as the filler material. In contrast to using a particulate filler, and to using a more viscous liquid filler, the use of a putty filler enables the device to have better squeezing characteristics. The use of a putty enables the ball to conform more exactly to one's hand grip, while allowing good resistance, weight and resiliency.

Preferably, the putty has a tacky consistency such that it will stick to the cover of the ball. The tacky material makes the cover adhere to the contour of the putty. The exerciser will, thus, feel more like a single uniform material—creating a more interesting object. Although less preferred, a non-tacky putty could be used.

The putty preferably does not flow in a liquid-like manner. Preferably, the putty is relatively freely compressed, but substantially maintains its shape once compressed. Putty is a good material for providing such characteristics. For example, PLAY DOGH (TM)—a common putty for children—is easily manipulated into specific shapes even by children.

The terminology putty also encompasses dough or dough-like substances with a similar consistency to putty. The putty is preferably made largely with edible substances. Preferably, the putty is made mostly with known food substances—e.g., products that are digestible and/or have nutritional value.

It is preferred that the putty has a high moisture content. Preferably, it has a water base. Most preferably, the putty is made with a flour and water base. The most preferred ingredients include: flour, water, salt, and cream of tartar or the like (e.g., potassium bitartrate). When these ingredients are mixed together and heated, the mixture can solidify into a putty substance. In one exemplary preferred embodiment, the putty is made with the following ingredients.

| | | |
|---|---|---|
| Flour | About 48% | (e.g., about 1 cup) |
| Water | About 35% | (e.g., about ¾ cup) |
| Salt | About 12% | (e.g., about ¼ cup) |
| Cream of Tartar | About 3% | (e.g., about 1 tablespoon) |
| Cooking Oil | About 1% | (e.g., about 1 teaspoon) |
| Fragrance | About 1% | (e.g., about 1 teaspoon) |

The flour, salt, cream of Tartar are mixed together (e.g., in a large bowl). The water is boiled. The boiled water and the oil are added to the mixture, and the mixture is stirred (e.g., until a large ball forms). The mixture is then allowed to cool (e.g., for about 10 minutes). Then, the mixture is kneaded (e.g., for about 1 minute). The kneaded mixture is placed within a plastic bag or within another air-tight material and allowed to cool (e.g., for set aside for several hours). The quantities within parentheses above can yield enough for about three hand exercisers. Mass production of the filler material can easily be performed using known means for carrying out the various steps. It should be understood that the various steps and/or ingredients can be modified by those within the art as long as the concepts of the invention are not departed from.

Although less preferred, the putty could be made to meet the performance qualities and characteristics as defined in this disclosure with other materials such as with various synthetic polymers.

The putty preferably fills the entire interior of the cover. The cover can even be stretched outward due to the putty therein. The squeezing pressure of one's hand imparts a force on the balloon layers which in turn impart an appropriate restoring elastic force. The putty is preferably smooth and free from debris or material dispersed therein so that when the device is squeezed, the material is not visually apparent beneath the balloon body surface. The use of a smooth putty avoids problems in other existing exercisers of (a) tearing, (b) filler disintegration and (c) undesirable appearance thereof beneath the surface. The putty also provides very preferable squeezing characteristics, such as good weight, resistance, and resiliency.

A putty filler is also preferred because it can help reduce unwanted spillage of filler material. The prior fillers included flowable particulate material which would readily spill out of the exerciser after the exerciser is torn. On the other hand, the putty filler will not readily spill when the cover is torn. In addition, the use of mostly edible ingredients can further reduce any potential hazards that can result from spilled filler material.

The preferred construction of the filler material can even tend to harden proximate any tear or opening, even further preventing filler from escaping through such an opening.

The Cover

The cover C is preferably made from a polymeric material, such as a latex elastomer or a flexible vinyl polymer such as flexible polyvinyl chloride. The cover can be constructed in a variety of ways. The cover C can be molded or otherwise formed into an enclosed shell in any known manner.

The cover C is preferably sufficiently air-tight to prevent the putty from drying out, e.g., when the putty has a high moisture content as in the preferred embodiments.

A preferred manner of making the cover C is illustrated in FIGS. 2(A)–2(D). As shown, the preferred ball body 100 includes a plurality of balloons 11, 12. The putty material 14 is packed inside the innermost balloon 11. As shown in FIG. 2(A), a balloon 11 made of a polymeric material having a significant elasticity, such as a latex elastomer, is used. Preferably, the balloon is of a common type having a shape (in an empty state) generally as shown in FIG. 2(A) with a generally rounded, or fuller, body section b extending from a narrow neck portion n with an outer bead rim r. The neck n and bead rim r are commonly used to facilitate (a) inflation of the balloon with air by attachment to a nozzle or placement within one's mouth and (b) closing of the balloon by tying to trap air therein. Preferably, the body section b is about 2 to 3 inches long and has a volume of about ⅓ cup (76 cc) when fully packed without being substantially elastically expanded. Appropriate balloons are readily available, such as that manufactured by Pioneer Balloon Company, model 9" round.

To begin the construction of the ball body 100, a balloon 11 can be filled with the putty 14 (FIG. 2(A)). The putty material generally does not freely flow on its own. As a result, it will not "spill" out of the balloon during filling. Because the putty is easy to manipulate, it is also easy to place within the balloons. For example, the putty can be injected into the balloon 11 through a nozzle or the like.

After the balloon 11 is filled, the balloon 11 is cut at the juncture between the neck portion n and the body portion b along the line L (FIG. 2(A)) to remove the neck portion. Alternatively, the neck portion n can also be removed prior to filling. However, cutting the neck portion after filling can facilitate handling during and after filling. If the balloon is filled prior to cutting, one can also raise or lower the line L depending on the amount of material actually filled—e.g. to maintain a proper level of material.

Thereafter, a second balloon 12 (of similar construction) is cut the line L, shown in FIG. 2(A). As shown in FIG. 2(C), the second balloon 12 is stretched over the first balloon 11. The opening 15 of the second balloon is, preferably, located at an opposite side, or otherwise offset from, the opening 15 of the first balloon. The outermost balloon can have a logo 16 (FIG. 1) pre-printed thereon, or can otherwise be colored and/or decorated prior to assembly.

Two balloons are used in the above described construction. However, additional balloons can be added outside the second balloon. Preferred embodiments contemplate the use of two or three balloons. In addition, further inner balloons 11' can be added, e.g. an inner balloon oppositely oriented to the balloon 11. In this latter case, the balloons 11, 11' would, preferably, each be cut along lines L so as to remove the neck portions n. Alternatively, a single balloon can be used to construct the ball body. Preferably, a single balloon would be made of a durable latex elastomer.

FIGS. 2(A)–2(C) also illustrate another embodiment of the cover which is preferred for use with the embodiment discussed below wherein attachment hardware is attached to the opening for attaching a key chain or the like. In this alternative construction of the cover C, one or more balloons 12, 13 are formed with short neck portions n' by cutting at the line L2. This provides additional material to be clamped within the attachment hardware as discussed below.

The Seal Member

In the embodiment illustrated in FIG. 1(A), a seal member 200 is provided in order to seal the opening in the outermost balloon. The seal member 200 can be included to ensure that the ball remains substantially air tight so as to retain the moisture within the filler. In this manner, the elasticity of the exerciser will remain substantially the same. The seal member also makes the exerciser spill-proof.

The seal member 200 preferably is made of a durable elastomer that is substantially thicker and stronger than the material of the outer balloon layer. For example, the member 200 can be over twice the thickness of the outer balloon, or even greater in size. The durable seal member 200 is adhered around the perimeter of the opening in the outermost balloon layer. Preferably, the overlapping portion 250 between the outer balloon layer and the seal member 200 (FIG. 1(A)) is attached with an strong adhesive or glue. The seal member can also be vulcanized thereto. The member 200 can be formed, for example, by cutting a circular portion out of a flat sheet material. The member 200 can also include indicia or writing 260 printed thereon. Use of a flat sheet facilitates printing of such indicia or writing.

In this manner, the opening of the outermost balloon layer is very strong, e.g., it can be stronger than the remainder of the balloon. The opening is, thus, not a "weak link" at which stress will concentrate and cause the cover to tear. This construction is highly preferable over the Scatterday technique (discussed above page 1) of merely gluing around the perimeter edge. Other known balls, simply use the same latex material of the balloon to close an outer opening. The known techniques have a tendency to loosen over time and result in spillage.

In alternative constructions, similar seal members 200 could also be included on inside balloon layers. This alternative construction can help to avoid increased forces against an outer balloon layer at a position corresponding to a balloon opening thereunder.

Two exemplary hand exercisers were constructed with a putty filler similar to that with the above noted preferred ingredients. The filler material was placed within two balloon layers and the outer balloon layer was sealed with a seal member 200. A first of the exercisers ("Exerciser #1") weighed about 7 ounces and had a diameter of about 2½ inches. The second of the exercisers ("Exerciser #2") weighed about 6.5 ounces and had a diameter of about 2¼ inches. FIGS. 3(A)–3(G) illustrate a number of tests that were conducted to illustrate characteristics of these particular exercisers. These exercisers represent examples only and the scope of this invention is not limited thereto. Some preferred embodiments will fall within a range of about 20%, and more preferably about 15%, and even more preferably about 10% of the initial height value higher or lower than the heights y obtained for the weights applied. More preferred embodiments of the hand exerciser have compression amounts within a range of between about 0.5 to 1.5 times the compression amounts illustrated in the FIGS., and even more preferably within a range of between about 0.75 to 1.25 times the compression amounts illustrated (the compression amount meaning the initial height minus the height y). The graphs also illustrate some preferred degrees of linearity in the compression of the products under such loads, e.g. having relatively small and relatively continuous degrees of change in compression amounts per pound applied.

Figure 3A:
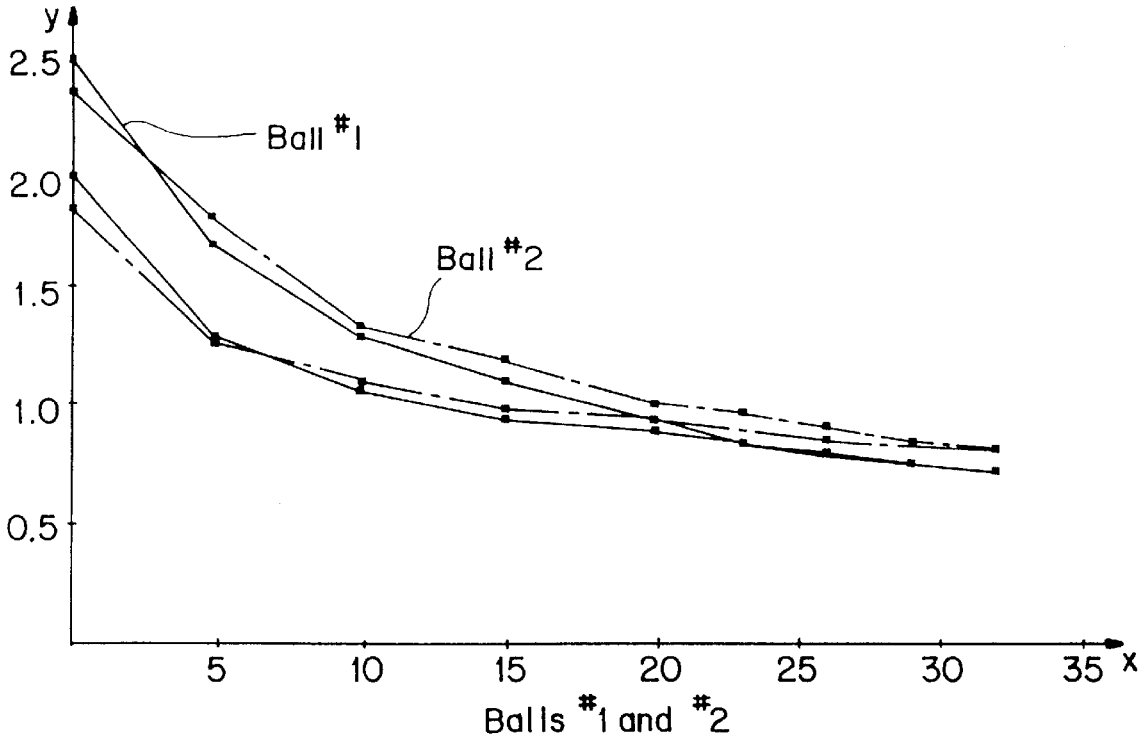
FIGS. 3(A)–3(E) are graphs showing compression vs. weight, illustrating exemplary characteristics of two example constructions of the first embodiment.
Figure 3B:
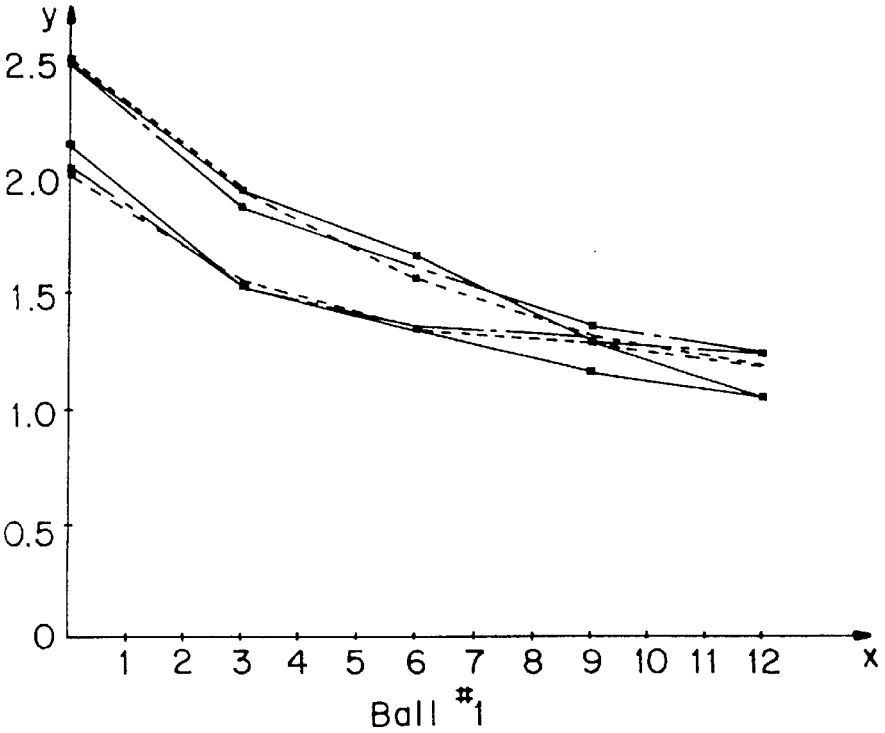
Figure 3C:
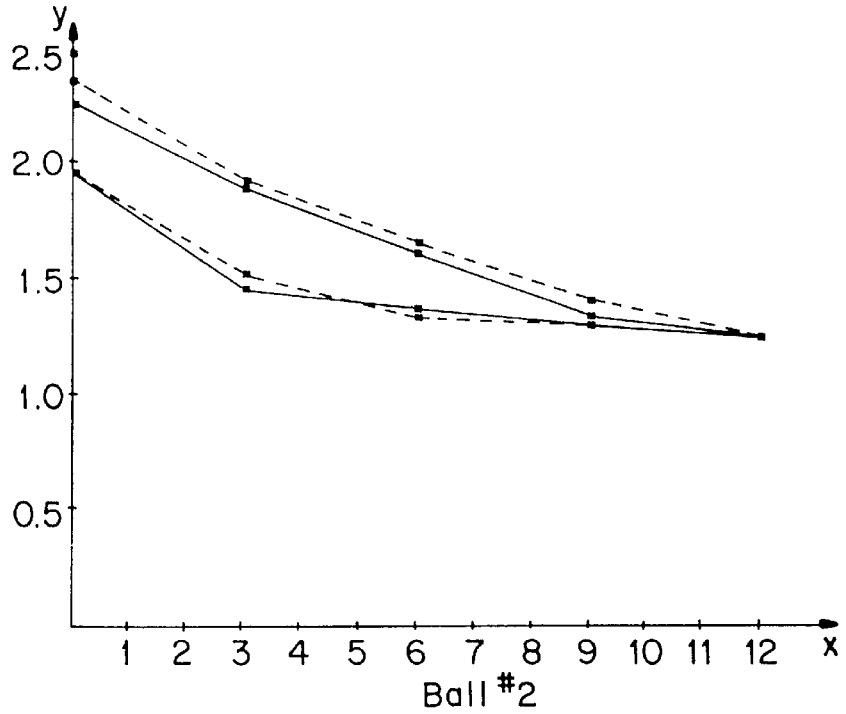

FIG. 3(A) is a graph showing a distance of compression corresponding to a weight applied to each hand exerciser. The measured diameters (in inches) are shown on the y axis, and the weights applied (in pounds) are shown on the x axis. As shown in FIG. 3(F), the exercisers A were placed upon a flat surface 1000 a hard sheet 1010 (of little weight) was placed upon the exercisers and weights W were applied upon the hard sheet to compress the exercisers. The exercisers were measured in their free state. Then, four approximately 5 lb. weights were individually applied. The diameter y was measured after the application of each of such weights. After the four 5 lb. weights were applied, four 3 lb. weights were similarly applied and the diameter was similarly measured. Thereafter, the 3 lb. weights were removed in pairs and the diameter was similarly measured. Thereafter, the 5 lb. weights were individually removed and the diameter was similarly measured, until no compressive force was applied. The measurements were obtained visually by observing an adjacent ruler 1020. The weights were applied and balanced by hand. The measurements were conducted after waiting about 30 seconds or more—to allow for delays in reaction—after applying or removing such weights. The solid line illustrates the results with Exerciser #1 and the dashed line illustrates the results with Exerciser #2. The lines each formed a "V" shape having a peak at the rightmost side because the exercisers did not fully return to their original size when the weights were removed. FIG. 3(B) illustrates similar tests on Exerciser #1 wherein four 3 lb. weights were sequentially placed and then removed. As illustrated by the three different line types, this test was conducted three times. FIG. 3(C) illustrates similar tests on Exerciser #2. These tests were the same as that conducted for exerciser #1 in FIG. 3(B). As illustrated by the two different line types, this test was conducted two times.

Figure 3D:
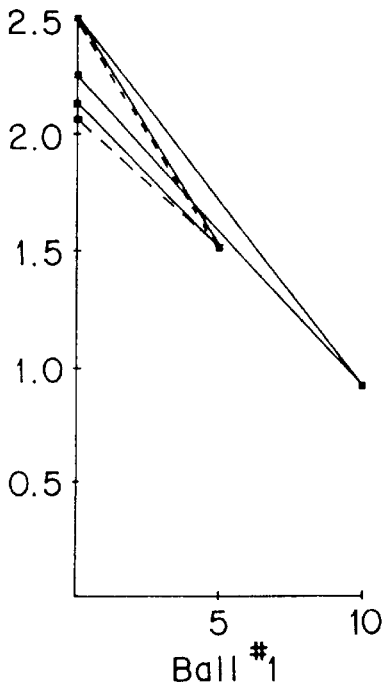
Figure 3E:
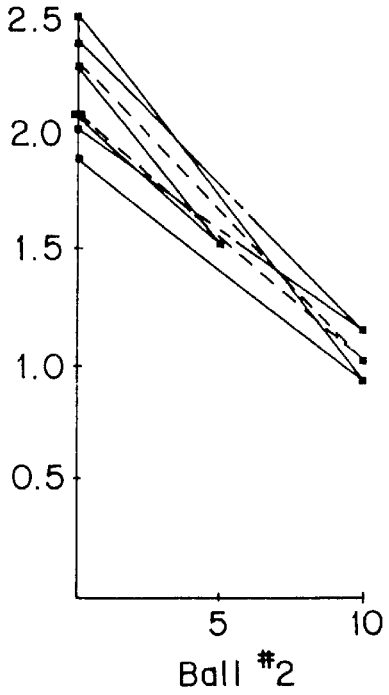
Figure 3G:
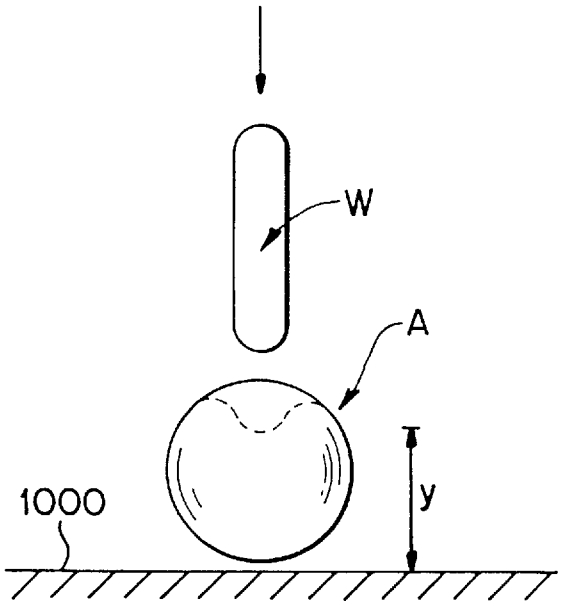
FIGS. 3(F)–3(G) illustrate tests conducted to generate the above graphs.
Figure 3F:
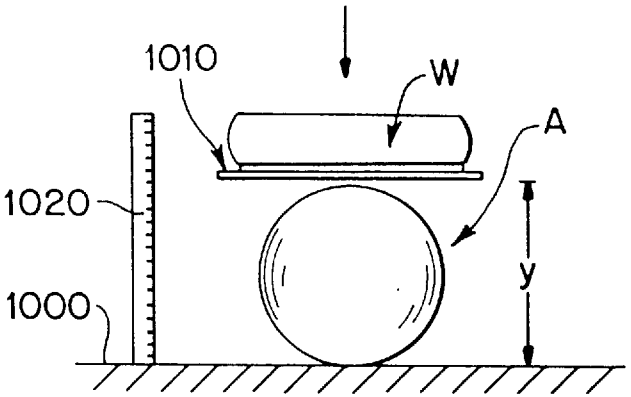

FIG. 3(D) illustrates a further tests conducted as shown in FIG. 3(G). An exerciser was measured at its initial free state and then measured after the side edge of a disc-shape approximately 5 lb. weight (having a diameter of about 6¾" and a width of about 27/32") was applied widthwise on the exerciser to observe the compression y. The test was conducted twice with the approximately 5 lb. weight, as shown in solid and dashed lines. As shown, the same test was applied once with an approximately 10 lb. weight. The approximately 10 lb. weight was disc-shape and had about an 8" diameter and a width of about 1 3/32". The measurements were obtained by visually observing an adjacent ruler, and the weights were applied by hand. FIG. 3(E) shows tests, like that of FIG. 3(D), but conducted on exerciser #2. As shown, the approximately 5 lb. weight was applied once, and the approximately 10 lb. weight was applied three times.

The Attachment Hardware

Figure 4:
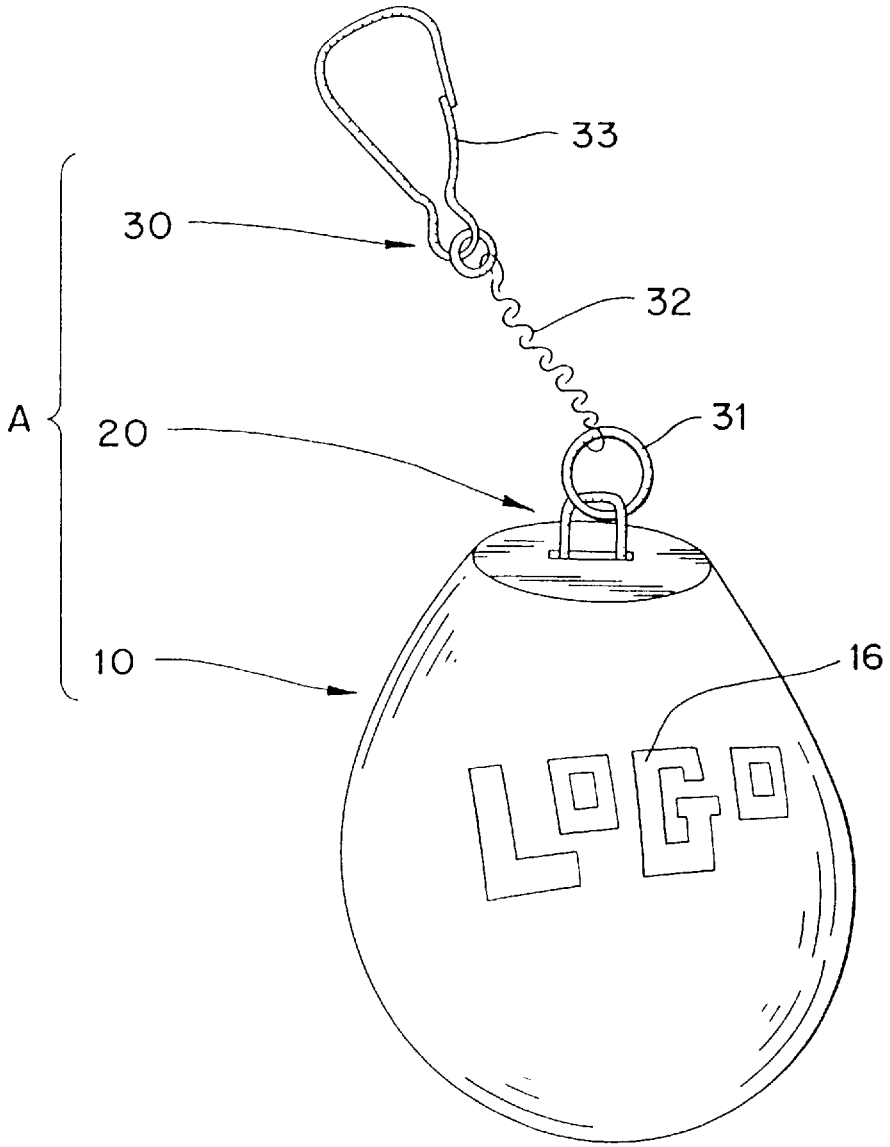
FIG. 4 is a perspective view of a hand exerciser according to a second embodiment of the invention.

FIG. 4 shows an alternative construction of the device which includes the attachment of a key chain or other attached object. FIG. 4 illustrates an assembly A according to a preferred embodiment of the invention including a ball body 10, attachment hardware 20, and a key chain 30. The ball body 10 is constructed in the same manner as the ball body 100 discussed above. That is, the cover C and filler material F are similar to that discussed above. However, the sealing member 200 is replaced by an attachment hardware 20.

Figure 5:
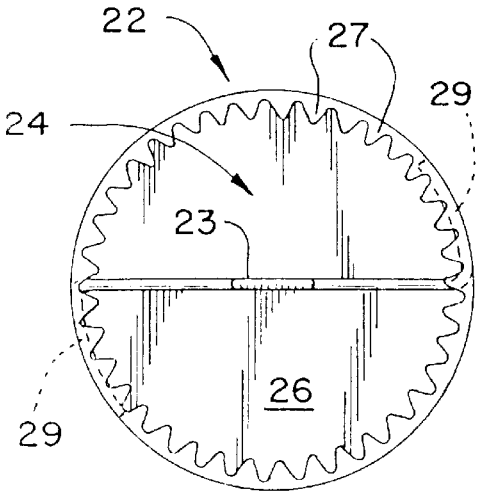
FIGS. 5(A)–5(F) illustrate a preferred embodiment of the attachment hardware of the invention, more specifically.
Figure 5:
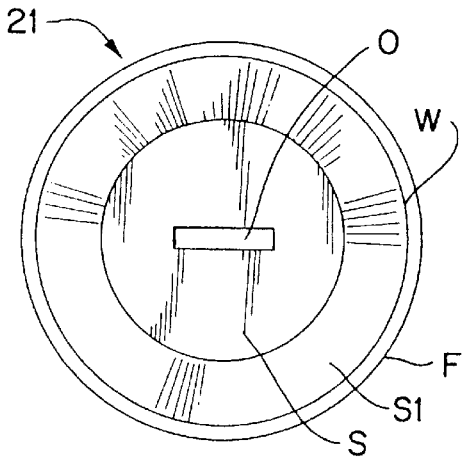
Figure 5:
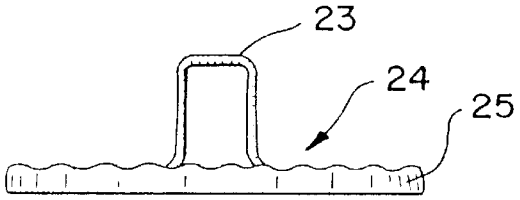
Figure 5:
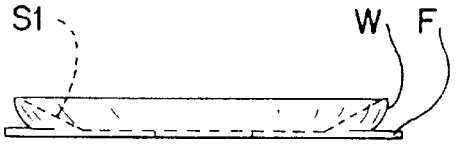
Figure 5:
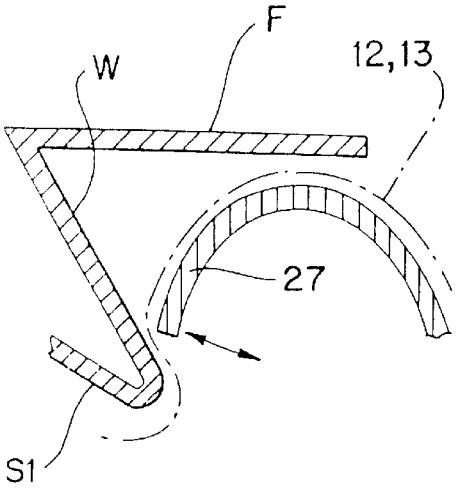
Figure 5:
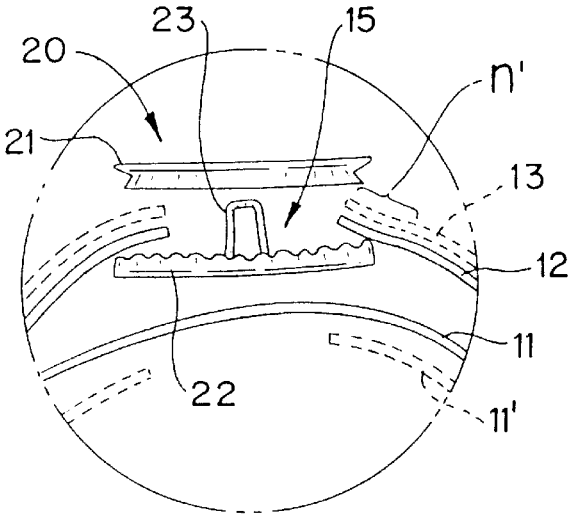

The attachment hardware 20 is mounted to the ball body 10 and provides a means for mounting the key chain 30 to the ball body 10. As shown in FIG. 5(E), the attachment hardware 20 preferably includes an outer attachment member 21 and an inner attachment member 22 which receive a portion of the balloons 12 (and possibly 13) therebetween and close the openings 15 therein. As shown in FIGS. 5(A) and 5(C), the inner attachment member 22 preferably includes a bowl 24 having an annular sidewall 25 and a bottom 26, a plurality of resilient teeth 27 extending inward and downwards from the top of the sidewall 25, and an attachment loop 23.

Preferably, the loop 23 is formed by a bent wire 28 which extends across the bottom 26, curves upwards in the middle to form the loop 23, and curves oppositely at both ends 29 along the inside of the sidewall 25 beneath the teeth 27 so as to fixedly hold the wire to the inner attachment member without adhesives, etc. Although less preferred, the loop can alternatively be attached to the outer attachment member. As shown in FIGS. 5(B) and 5(D), the outer attachment member preferably includes an outer flange F, an outwardly inclined engagement wall W, and an inner disc-surface S with a slot O therethrough.

The inner and outer attachment members 21, 22, including the loop 23, are preferably made of a generally rigid and generally strong material. Preferably, it is made of a metal, such as aluminum, but it can also be constructed of a hard plastic, or other suitable material.

In the preferred construction shown in FIG. 5(E), the inner attachment member 22 is initially placed inside the balloon layer 12, and the neck portion n' is stretched therearound. The inner attachment member is preferably placed inside the balloon layer 12 prior to wrapping another balloon layer 13 thereover (if such a balloon 13 is included). The inner attachment member can be "retained" in place by the resiliency of the balloon layer(s), making fabrication easy.

Once the inner attachment member is within the balloons, the neck portions n' of the balloons 12, 13 are tucked inside the bowl 24. Then, the outer attachment member 21 is snapped to the inner attachment member 22 so that the balloon neck portions n' of the second and third balloons are sealed inside and between the inner and outer attachment members. Snapping, or clamping, the two members together is facilitated because gripping both sides of the attachment hardware is enabled due to the "stretchability" of the balloons and to the free flowing of the particulate material—e.g. it is easy to grasp below the inner attachment member.

Preferably, the inner disc-surface S includes an inclined wall section Si providing additional space within the attachment hardware to receive the neck portions n'. The diameter across the inner attachment member between the inner ends of the teeth 27 is slightly less than the diameter across the outer attachment member between the upper ends of the wall W (lower end as shown in FIG. 3(E)). As a result, the top of the wall W abuts the teeth 27 when pressed thereagainst, and the teeth deflect (see arrows in FIG. 3(E)) until the pieces snap together to a locked position wherein the teeth 27 press towards and/or lock behind the wall W and wherein the flange F covers the teeth 27 and extends toward or over the sidewall 25. The teeth can be used to firmly grasp the elastomeric balloons to effect a firm hold. The teeth are, preferably, slightly rounded at the ends thereof such that they do not penetrate/tear the elastomeric balloons, but merely grip the balloon material.

Preferably, the diameter of the openings 15 in the balloons 12 and 13 created by cutting along the line L2 is less than that of the inner and outer attachment members, such that the short neck portions n' will tend to bend around the inner attachment member and between the attachment members (such as to the position shown in FIG. 3(F)) to facilitate clamping therein.

As shown, in the preferred construction, the openings 15 and the inner and outer attachment members are generally circular. This helps to evenly distribute tensile forces that could damage the balloons 12 and 13 around the attachment hardware and around the holes 15. However, non-circular shapes are also contemplated. Nevertheless, such other shapes preferably should have rounded edges. Similarly, the openings and seal member(s) 200 in the previously discussed embodiment are also preferably generally circular.

The above construction enables an object to be fixedly attached to the balloons in a manner to avoid tearing or damaging the balloons, despite the fact that it is very difficult to attach an object to a thin elastomeric material. After the ball body 10 and the attachment hardware 20 have been connected, an external object can be attached to the loop 23. In the most preferred construction, a key chain 30 is attached thereto. As shown in FIG. 1, the key chain 30 preferably includes a ring 31 attached to loop 23, a chain 32 extending from the ring 31, and a key holder 33 at the distal end of the chain 32. Alternatively, the loop 23 can be used to anchor another object such as a tether (e.g., to facilitate carrying the device), a hook, or a necklace or the like.

The Functions And Benefits

The present hand exerciser can help to increase one's strength and dexterity in one's fingers, hands, wrists, and arms. It can also help to a) reduce stress and tension, b) reduce stiffness and pain, such as due to arthritis, and even c) reduce blood pressure.

It is contemplated that the hand exerciser can be placed within a microwave oven (e.g., for a short time period) or otherwise subject to heating so as to provide heat therapy for relaxation of the muscles in one's hand. When heated, the exerciser can readily distribute heat to one's hand to relax the muscles in one's hand. Because the exerciser conforms well to one's grip, the conduction of heat is facilitated and the quality of the heat distribution is enhanced.

When additional flexibility of the exerciser is desired, it can be subject to heating, such as by placement within a microwave oven for about 20 seconds. The preferred embodiments of the invention contemplate the allowance for these heating capabilities. However, although less preferred, the device could be used otherwise, or, for whatever reason, could be made so as to be unable to be subjected to such heating, etc. It should be readily understood that the attachment hardware embodiment is preferably not microwavable. In particular, metal keys are not microwavable. However, the attachment hardware could be constructed from a microwavable plastic. And, the keys could be adapted to be separated by snap connections or the like.

It is contemplated that the present hand exerciser can also be used as a cold therapy device. It can be cooled, such as within a freezer, and then used for cold therapy, e.g., for relaxation by holding the cooled item within one's hand.

In contrast to using a particulate filler and to using a more viscous liquid filler, the use of a putty filler enables the device to have better squeezing characteristics. The use of a putty enables the ball to conform more exactly to one's hand grip, while allowing good resistance, weight and resiliency. The use of a putty filler also helps reduce unwanted spillage of filler material. The prior fillers included flowable particulate material which would readily spill out of the exerciser when the cover is torn. On the other hand, the putty filler will not readily spill when the cover is torn. In addition, when the putty has a tacky consistency, the cover conforms to the contour of the putty. The exerciser will, thus, feel more like a single uniform material—creating a more interesting object. The use of mostly edible incredients further reduces any potential hazards that can result from spilled filler material.

While the present invention has been shown and described with reference to preferred embodiments presently contemplated as best modes for carrying out the invention, it is understood that various changes may be made in adapting the invention to different embodiments without departing from the broader inventive concepts disclosed herein and comprehended by the claims which follow.

What is claimed is:

1. A hand held exerciser, comprising:

a) a ball body including an elastomeric shell and a filler material within said elastomeric shell;

b) said elastomeric shell being made from a resilient and stretchable elastomeric material, said elastomeric shell having an interior cavity defined within said shell;

c) said filler material filling the entire cavity within said shell, said filler material comprising a moist putty which substantially maintains its shape without flowing, but which freely moves when compressed;

d) said elastomeric shell being sufficiently airtight so as to retain moisture within said putty.

2. A hand held exerciser, comprising:

a) a ball body including an elastomeric shell and a filler material within said elastomeric shell;

b) said elastomeric shell being made from a resilient and stretchable elastomeric material, said elastomeric shell having an interior cavity defined within said shell;

c) said filler material filling the entire cavity within said shell, said filler material comprising a putty which substantially maintains its shape without flowing, but which freely moves when compressed.

3. The hand exerciser as recited in claim 2, wherein said putty has a tacky consistency such that it sticks to the interior of said elastomeric shell.

4. The hand exerciser as recited in claim 3, wherein said putty is made mostly of edible substances that are digestible or have nutritional value.

5. The hand exerciser as recited in claim 4, wherein said putty is made with a flour and water base.

6. The hand exerciser as recited in claim 3, wherein said hand exerciser compresses an amount within a range of between 0.5*.25% to 1.5*.25% below its initial height when subject to 3 pounds of compression.

7. The hand exerciser as recited in claim 3, wherein said hand exerciser compresses an amount within a range of between 0.75*.25% to 1.25*.25% below its initial height when subject to 3 pounds of compression.

8. The hand exerciser as recited in claim 6, wherein said hand exerciser compresses less than 70% from its initial height when subject to 12 pounds of compression.

9. The hand exerciser as recited in claim 8, wherein said exerciser returns to at least 67% of its initial height after releasing the 12 pounds of compression.

10. The hand exerciser as recited in claim 9, wherein said exerciser is generally circular and has a diameter of between 2 and 4 inches.

11. The hand exerciser as recited in claim 10, wherein said exerciser is generally circular and has a diameter of between about 2 to 3 inches.

12. The hand exerciser as recited in claim 11, wherein said exerciser weighs between about 5 and 10 ounces.

13. The hand exerciser as recited in claim 2, wherein said putty includes the following ingredients: flour, water, salt, and cream of tartar.

14. The hand exerciser as recited in claim 3, wherein said cover comprises at least one balloon.

15. The hand exerciser as recited in claim 14, wherein an outermost one of said balloons has an opening therethrough, said opening being sealed with a seal member, said seal member having a tear strength substantially greater than the tear strength of said balloon and being sealed to said outermost balloon around the perimeter of said opening.

16. The hand exerciser as recited in claim 15, wherein said at least one balloon consists of two balloon layers.

17. The hand exerciser as recited in claim 15, wherein said at least one balloon consists of three balloon layers.

18. The hand exerciser as recited in claim 14, wherein the outermost of said at least one balloon has indicia printed on an outer surface thereof.

19. The hand exerciser as recited in claim 14, wherein an outermost one of said balloons has an opening therethrough, said opening being closed by attachment hardware including an inner attachment member and an outer attachment member which together clamp to a perimeter edge of said opening in the outermost balloon.

20. The hand exerciser as recited in claim 19, wherein said attachment hardware includes a loop for attaching an external object.

21. The hand exerciser as recited in claim 20, further including a key chain attached to said loop.

22. The hand exerciser as recited in claim 21, wherein said outermost balloon has indicia printed on an outer surface thereof.

23. A method of exercising an individual's hands, comprising the steps of:

1) providing a hand held exerciser having a) a ball body including an elastomeric shell and a filler material within said elastomeric shell;

b) said elastomeric shell being made from a resilient and stretchable elastomeric material, said elastomeric shell having an interior cavity defined within said shell;

c) said filler material filling the entire cavity within said shell, said filler material comprising a putty which substantially maintains its shape without flowing, but which freely moves when compressed;

2) placing the hand held exerciser within the palm of an individual's hand; and 3) having the individual repeatedly compress the hand exerciser within his hand with sufficient force to exercise the muscles within the individual's wrist.

24. The method of claim 23, further including the step of sticking the putty to the inside surface of the shell by providing said putty with a tacky consistency such that it sticks to the interior of said elastomeric shell.

25. The method of claim 24, further comprising the step of providing said putty from substantially only edible substances that are digestible or have nutritional value.

26. The method of claim 25, further comprising the step of providing said putty from ingredients including flour and water.

* * * * *